US005390648A

United States Patent [19]

Yanase

[11] Patent Number: 5,390,648

[45] Date of Patent: Feb. 21, 1995

[54] ELECTRICALLY WIRING PARTS MOUNTED ON AN ENGINE

[75] Inventor: Takeshi Yanase, Shizuoka, Japan

[73] Assignee: Yazaki Corporation, Tokyo, Japan

[21] Appl. No.: 13,925

[22] Filed: Feb. 5, 1993

[30] Foreign Application Priority Data

Feb. 26, 1992 [JP] Japan ..... 4-039298

[51] Int. Cl.[6] ..... F02P 11/00

[52] U.S. Cl. ..... 123/634; 439/130

[58] Field of Search ..... 123/634, 470, 647, 436, 123/195 C, 195 E, 198 E, 635; 439/130, 652, 34

[56] References Cited

U.S. PATENT DOCUMENTS

| | | | |
|---|---|---|---|
| 4,706,639 | 11/1987 | Boyer et al. | 123/647 |
| 4,834,056 | 5/1989 | Kawai | 123/634 |
| 4,857,003 | 8/1989 | Hafner et al. | 123/470 |
| 4,903,675 | 2/1990 | Huntzinger et al. | 123/635 |
| 5,030,116 | 7/1991 | Sakai et al. | 123/470 |
| 5,086,743 | 2/1992 | Hickey | 123/436 |
| 5,127,382 | 7/1992 | Imoehl | 123/470 |

FOREIGN PATENT DOCUMENTS

| | | | |
|---|---|---|---|
| 0512357 | 11/1992 | European Pat. Off. | 123/634 |
| 3542997 | 6/1986 | Germany | 123/634 |

OTHER PUBLICATIONS

Japanese Utility Model Unexamined Publication Hei. 4-65959.

Manual of Cresta, Aug., 1990.

*Primary Examiner*—Raymond A. Nelli

*Attorney, Agent, or Firm*—Sughrue, Mion, Zinn, Macpeak & Seas

[57] ABSTRACT

An electrically wiring arrangement mounted on the upper portion of a gasoline engine in an automobile or the like in which the current receiving connectors can be readily engaged with the current supplying connectors of a wire harness. Mounting parts, namely, ignition coils, are mounted above the cylinders, respectively, forming the upper portion of an engine body with screws. Each ignition coil has a current receiving connector on top which has contact terminals extending upright. An igniter having an external current receiving connector is mounted on the inner surface of one end portion of the cylinder head cover, and current supplying terminals, each of which has a connector housing in which female metal terminals are disposed, are mounted on the same inner surface of the cylinder head cover in such a manner that they are in alignment with the contact terminals of the ignition coils. The female metal terminals are connected to the igniter through conductors arranged in a predetermined circuit pattern.

4 Claims, 7 Drawing Sheets

ELECTRICALLY WIRING PARTS MOUNTED ON AN ENGINE

BACKGROUND OF THE INVENTION

This invention relates to an electrically wiring parts which are mounted on the upper portion of an gasoline engine, for instance, in an automobile.

FIG. 9 is an exploded perspective view for a description of a first conventional electrically wiring parts mounted on an engine.

As shown in FIG. 9, ignition coils a are mounted on cylinders, respectively, which are formed in a cylinder head c which forms the upper portion of an engine body b. The lower ends of the ignition coils a are connected to ignition plugs d mounted on the cylinders, respectively. The ignition coils a have connectors al on top, respectively, which are faced laterally. The connectors $a_1$ are engaged with connectors el which are connected to an igniter e through a wire harness f.

The wire harness f connecting the connectors el to the igniter e is protected by a cylinder head cover g which is fixedly mounted on the cylinder head c with screws gl.

The conventional method is designed as described above. That is, first, the laterally faced connectors al of the ignition coils a mounted on the cylinder head c are connected to the respective connectors el of the wire harness f, and then the cylinder head cover g is secured to the cylinder head c with the screws gl, so that the wire harness is protected by the cylinder head cover g.

In other words, in the conventional method, the connectors el of the wire harness f must be connected to the laterally faced connectors al of the ignition coils a one at a time. This connecting work takes time and labor.

The part (A) of FIG. 10 is an exploded perspective view for a description of a second conventional electrically wiring parts mounted on an engine.

As shown in the part (A) of FIG. 10, injectors h are mounted on an intake manifold j provided on the side of cylinders, which are provided in a cylinder head c′ forming the upper portion of an engine body b′. The injectors h have connectors hl on top through which current are supplied thereto. Those connectors hl are connected to connectors kl of a wire harness k, respectively, which is laid through a protector m (cf. the part (B) of FIG. 10).

The second conventional method is designed as described above. That is, first, the wire harness k is laid through the protector m, and then the connectors kl of the wire harness k are engaged with the connector hl of the injectors h which are mounted on the intake manifold j provided on the side of the cylinders, which are provided in the cylinder head c′ forming the upper portion of the engine body b′.

Hence, in the second conventional method, too, it takes a lot of time and labor to lay the wire harness k through the protector m, and to connect the connectors hl of the injectors h to the connectors kl of the wire harness k thus laid.

SUMMARY OF THE INVENTION

In view of the foregoing, an object of this invention is to provide an electrically wiring parts mounted on the upper portion of a gasoline engine in which the current receiving connectors of the parts can be readily engaged with the current supplying connectors of a wire harness.

The foregoing object of this invention has been achieved by the provision of an electrically wiring parts such as ignition coils and injectors which are mounted on the upper portion of an engine in such a manner that they are provided for the cylinders of the engine, respectively, and signals or the like are distributed to the parts through a wire harness, in which, according to the invention, current supplying connectors for the parts are formed on the inner surface of a cylinder head cover in such a manner that the current supplying connectors are in alignment with current receiving connectors provided for the parts, and a current supplying circuit for the current supplying connectors, and current receiving connectors for the current supplying circuit are formed on said cylinder head cover.

As was described above, in the electrically wiring parts such as ignition coils and injectors which are mounted on the upper portion of an engine in such a manner that the parts are provided for the cylinders of the engine, respectively, and signals or the like are distributed to the parts through a wire harness, the current supplying connectors are formed on the inner surface of a cylinder head cover in such a manner that the they are in alignment with the current receiving connectors provided for the parts, and the current supplying circuit for the current supplying connectors, and the current receiving connectors for the current supplying circuit are also formed on the inner surface of the cylinder head cover.

Hence, when the cylinder head cover is mounted on the cylinder head, the current supplying connectors provided for the parts are automatically engaged with the connectors of the parts; that is, the former connectors are electrically connected to the latter connectors. Therefore, electrical wiring of all the parts mounted on the upper portion of the engine is achieved merely by electrically connecting only one current receiving connector of the current supplying circuit to the external power source.

BRIEF DESCRIPTION OF THE DRAWING(S)

FIG. 1 is an exploded perspective view for a description of a first embodiment of this invention.

The part (A) of FIG. 2 is a perspective view of a cylinder head cover in the first embodiment, and the part (B) of FIG. 2 is a sectional view taken along line A—A in the part (A) of FIG. 2.

Figure 5A:
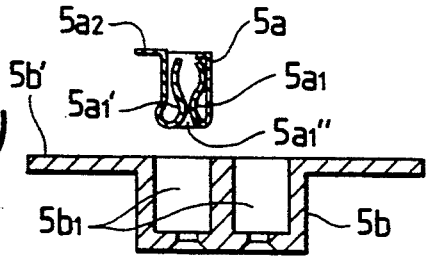
Figure 5B:
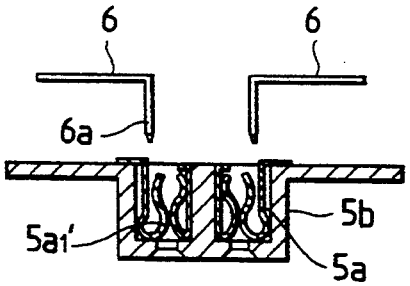
Figure 5C:
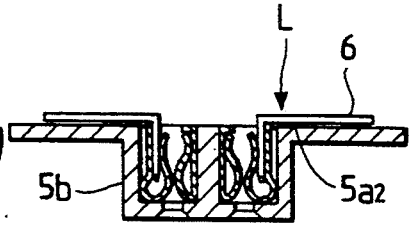

FIGS. 5 (A), (B) and (C) are vertical sectional views for a description of the manufacture of the connector housing.

Figure 6A:
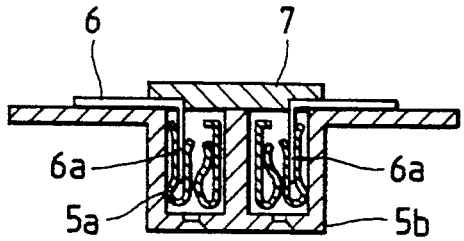
Figure 6B:
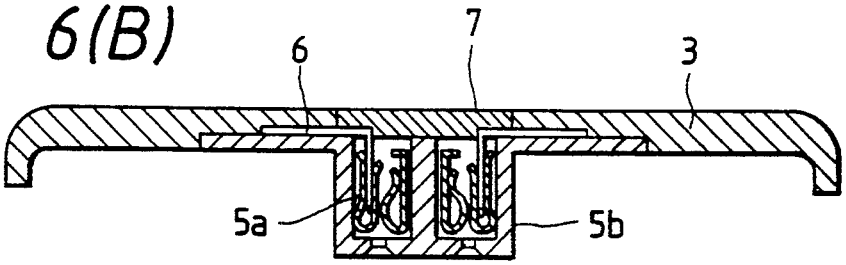

FIGS. 6 (A) and (B) are vertical sectional views for a description of the manufacture of the cylinder head cover.

Figure 7:
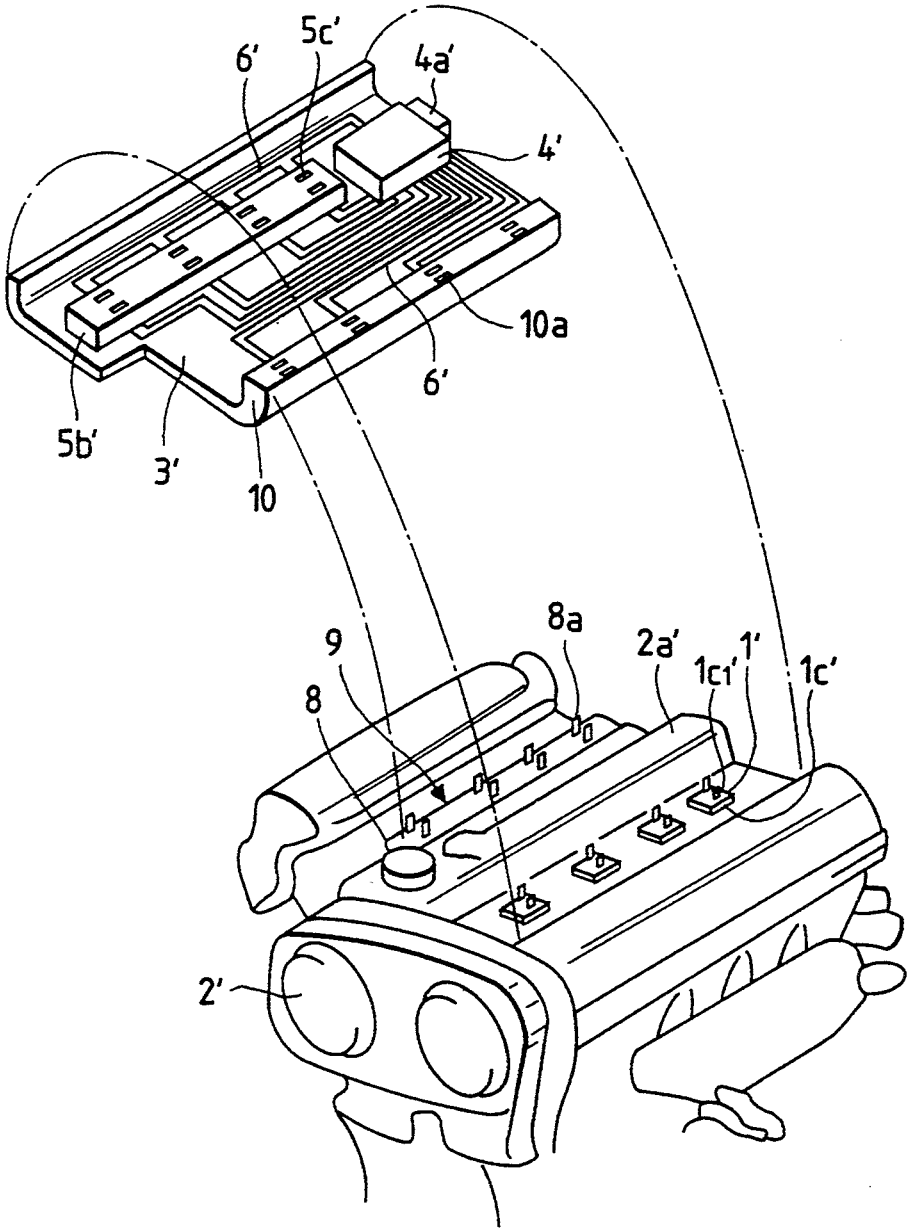

FIG. 7 is an exploded perspective view for a description of a second embodiment of the invention.

Figure 8:
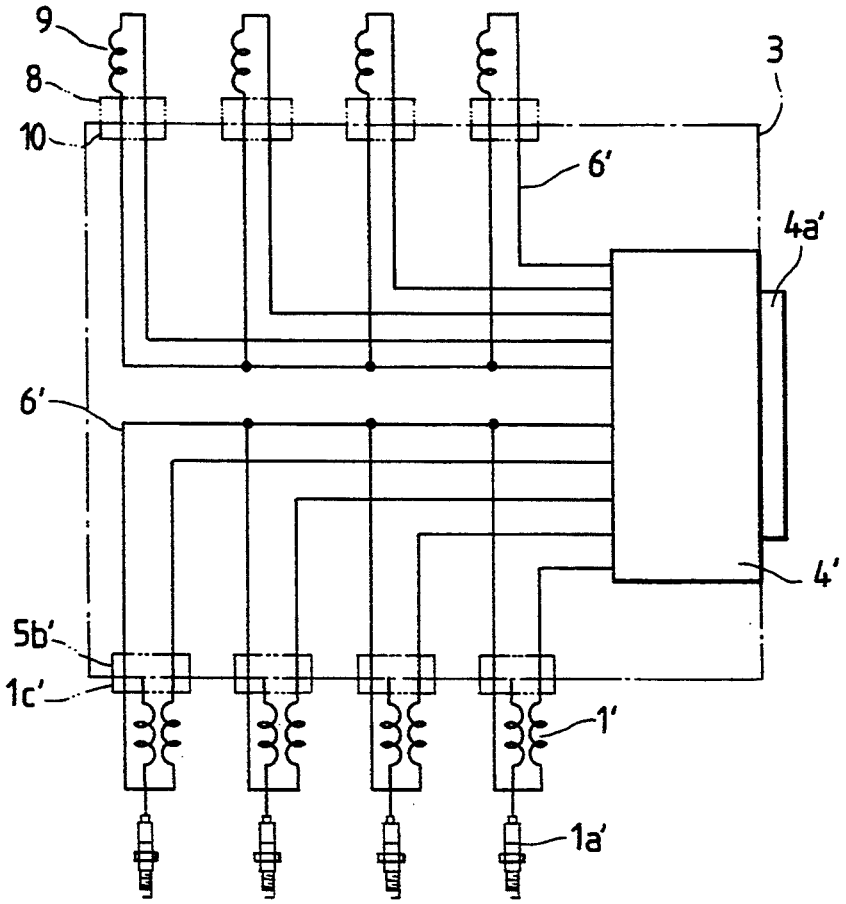

FIG. 8 is a wiring diagram for a cylinder head cover in the second embodiment.

Figures 9A, 9B:
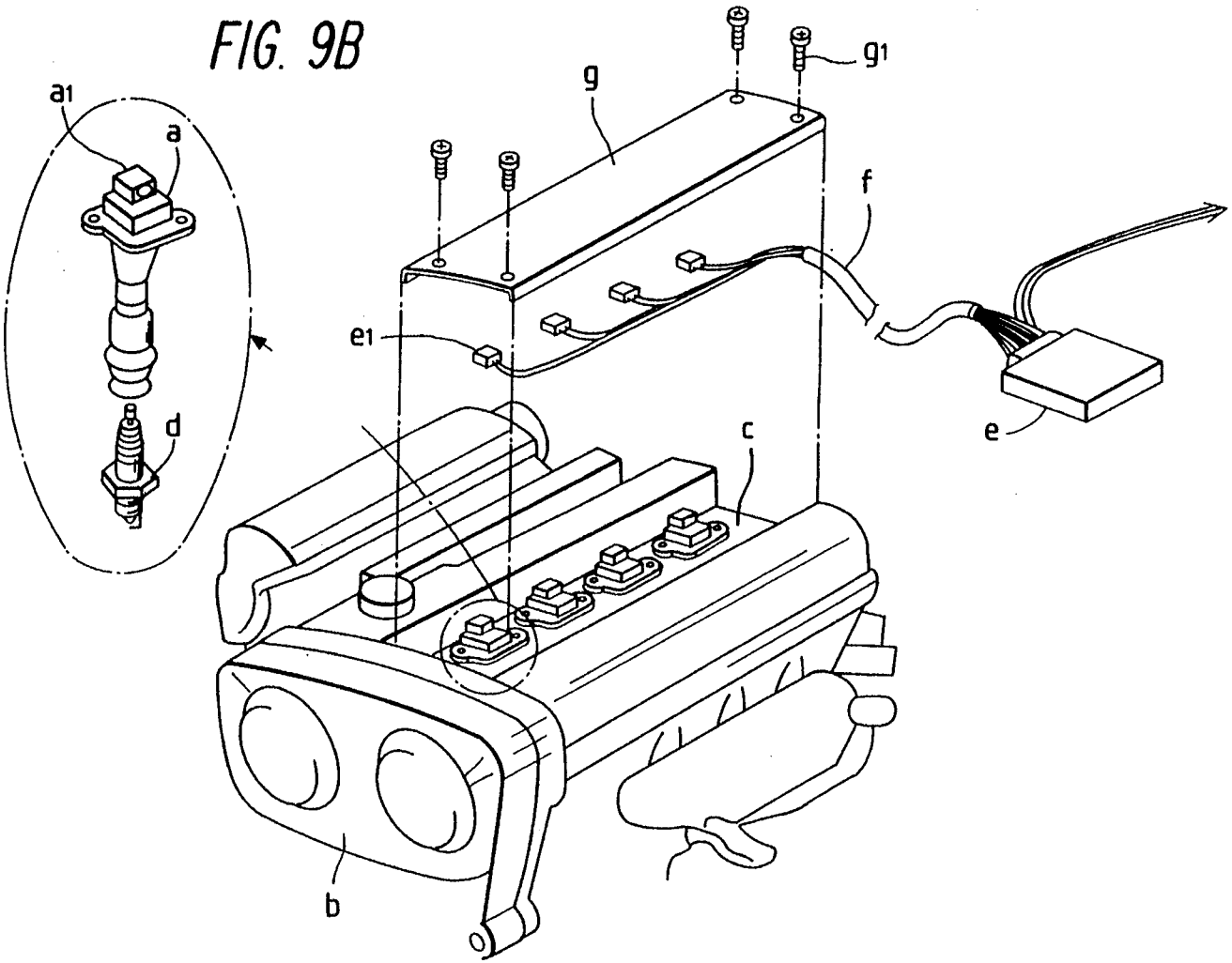

FIG. 9 is an exploded perspective view for a description of a first conventional method of electrically wiring parts mounted on an engine.

Figure 10A:
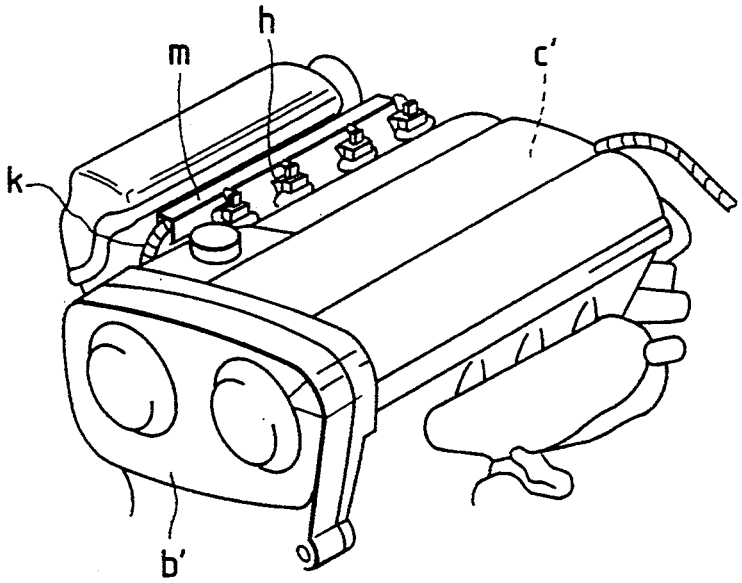
Figure 10B:
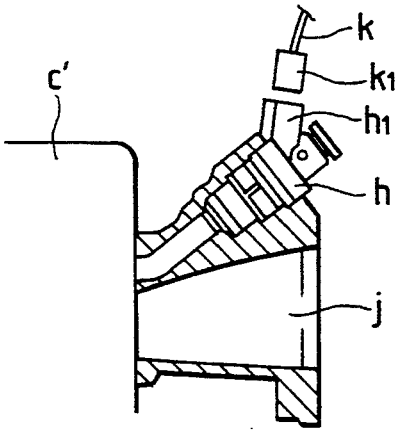

FIG. 10 (A) is an exploded perspective view for a description of a second conventional method of electrically wiring parts mounted on an engine; and FIG. 10 (B) is a vertical sectional view showing an injector and its relevant parts.

DETAILED DESCRIPTION OF THE PREFERRED EMBODIMENTS

Figure 1A:
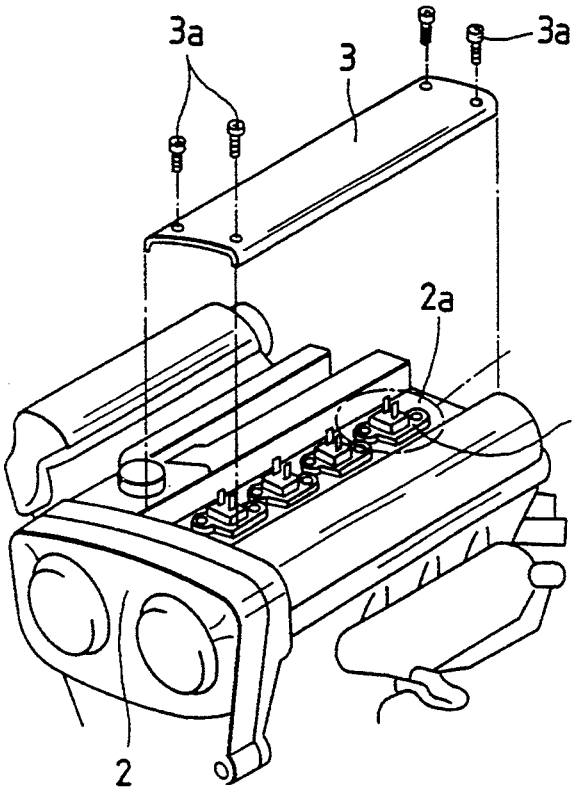
Figure 1B:
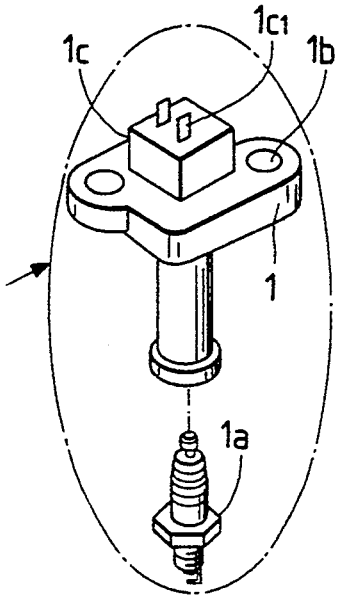

FIG. 1 is an exploded perspective view for a description of a first embodiment of this invention.

As shown in FIG. 1, parts mounted on the upper portion of an engine, namely, ignition coils 1 are fixedly mounted above cylinders in the cylinder head 2*a* of an engine body 1 with screws (not shown) inserted into through-holes 1*b*, in such a manner that the spark sections of the ignition coils 1*a* are exposed inside the cylinders. Each of the ignition coils 1 thus mounted has a current receiving connector 1*c* on top which has contact terminals $1c_1$ set upright.

Figure 2A:
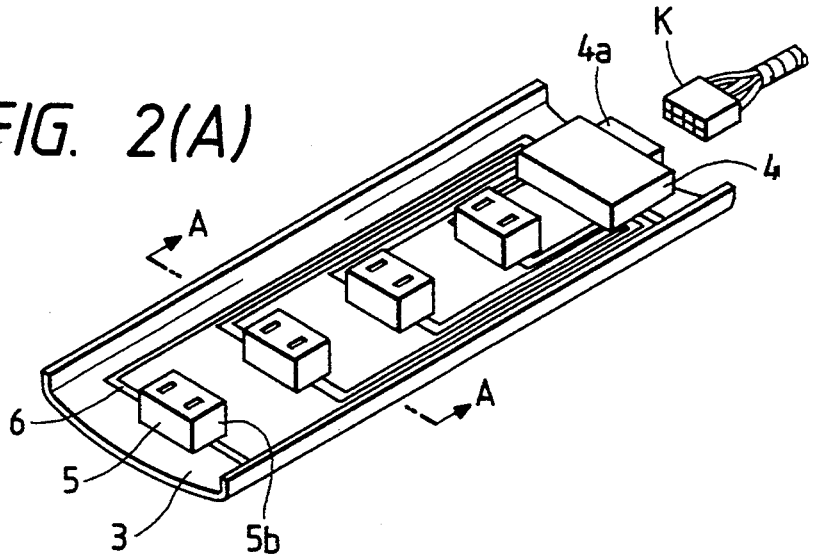
Figure 2B:
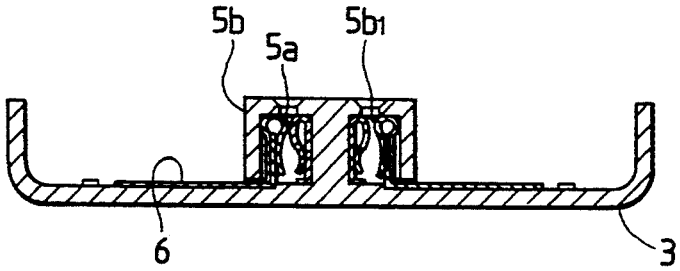

As shown in the part (A) of FIG. 2, an igniter 4 having a current receiving connector 4*a* provided on the outside is mounted on the inner surface of one end portion of a cylinder head cover 3 which is made of polybutylene terephthalate or the like, and current supplying connectors 5 are provided on the same inner surface in correspondence to the contact terminals $1c_1$ of the above-described ignition coils 1. The connectors 5 are made of polybutylene terephthalate or the like, and have connector housings 5*b* incorporating female metal terminals 5*a*. The female metal terminals 5*a* are connected to predetermined connecting parts of the igniter 4 through conductors 6 such as bus bars arranged in a predetermined circuit pattern, as shown in the part (B) of FIG. 2.

The part (B) of FIG. 2 is a sectional view taken along line A—A in the part (A) of FIG. 2. As shown in the part (B) of FIG. 2, each of the connector housings 5*b* has a pair of recesses $5b_1$ and $5b_1$, in which the female metal terminals 5*a* and 5*a* are inserted respectively. Each of the female metal terminals is made up of a pair of electrical contact pieces $5a_1$. Both of the electrical contact pieces $5a_1$ are folded; however, one of them is so folded to provide a fold gap $5a_1'$ which is to receive the tab-shaped contact piece 6*a* of the respective one of the conductors 6 forming the circuit pattern. The pair of electrical contact pieces $5a_1$ and $5a_1$ form a gap to receive the contact terminal $1c_1$ of the ignition coil 1. The base plate portion $5a_2$ of each female metal terminal 5*a* is welded to the respective conductor 6 (cf. FIGS. 3 and 5).

Figure 4:
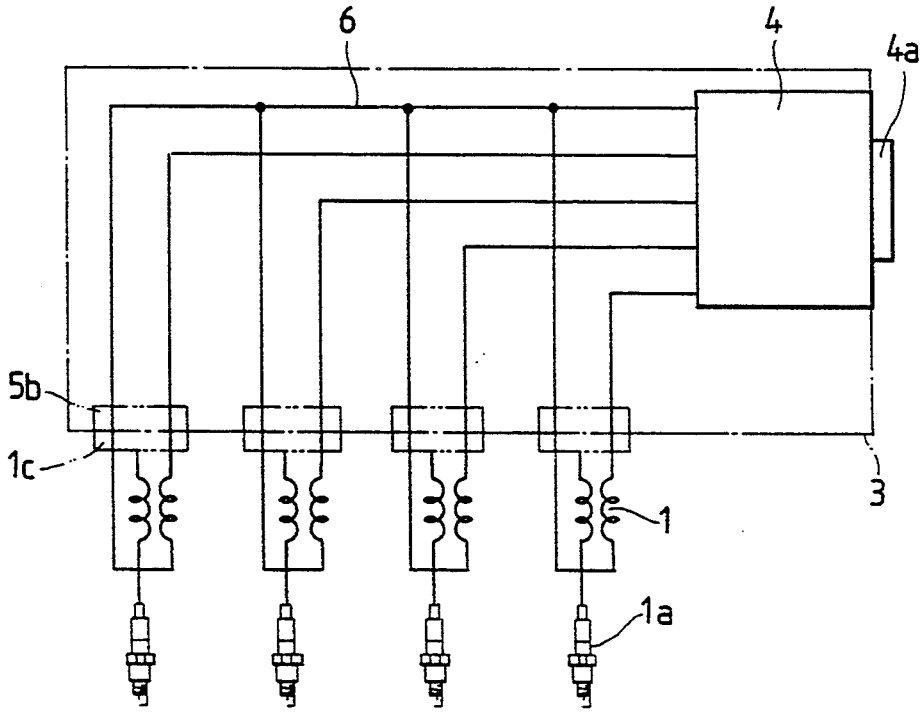
FIG. 4 is a wiring diagram of an ignition system in the first embodiment.

FIG. 4 is a wiring diagram of an ignition system in the invention. The conductors 6 extended from the igniter 4 mounted on the cylinder head cover 3 (indicated by the one-dot chain lines) are electrically connected through current receiving connectors 1*c*, which are connected to the connector housings 5*b* (indicated by the two-dot chain lines), to the ignition coils 1 mounted above the cylinders of the engine body 2, and to the ignition plugs 1*a*.

The first embodiment of the invention is designed as described above. Hence, in manufacture of the cylinder head cover 3, as shown in the part (A) of FIG. 5, the pair of electrical contact pieces $5a_1$ and $5a_1$ of each female metal terminal 5*a* are bent inwardly to form a contact gap $5a_1''$, and one of the electrical contact pieces $5a_1$ is so folded as to form the fold gap $5a_1'$ to receive the tab-shaped contact piece 6*a* of the respective conductor 6 in the circuit pattern as was described before.

Next, the electrical contact pieces $5a_1$ and $5a_1$ of a pair of female metal terminals 5*a* are inserted into the pair of recesses $5b_1$ and $5b_1$ of each connector housing 5*b*, respectively, until the base plate portions $5a_2$ thereof abut against the base plate portion 5*b*' of the connector housing 5*b*.

Thereafter, as shown in the part (B) of FIG. 5, the tab-shaped contact pieces 6*a* of the conductors 6, which are arranged in a predetermined pattern by themselves or on a film-shaped substrate, are inserted into the fold gaps 5*a* of the female metal terminals 5*a*. Under this condition, as shown in the part (C) of FIG. 5, the conductors 6 are welded to the base plate portions $5a_2$ of the female metal terminals 5*a* by soldering, or by laser as indicated at L.

Next, as shown in the part (A) of FIG. 6, each pair of tab-shaped contact pieces 6*a* and 6*a* are covered with a rear cover 7 which is made of polybutylene terephthalate or the like. The assembly of the female metal terminals 5*a*, the conductors 6, and the rear covers 7 is subjected to double molding by using a predetermined metal mold, to form the cylinder head cover 3 (cf. the part (B) of FIG. 6).

Thereafter, as shown in the part (A) of FIG. 2, the igniter 4 is mounted on the inner surface of one end portion of the cylinder head cover 3, and the tab-shaped contact pieces of the other ends of the above-described conductors 6 are inserted into the current supplying connector (not shown) of the igniter 4 thus mounted so that the former are electrically connected to the latter.

Next, as shown in FIG. 1, the cylinder head cover 3 is mounted on the cylinder head 2*a* with screws 3*a* which has the ignition coils 1 mounted above the cylinders in the upper portion of the engine body 2.

Figure 3:
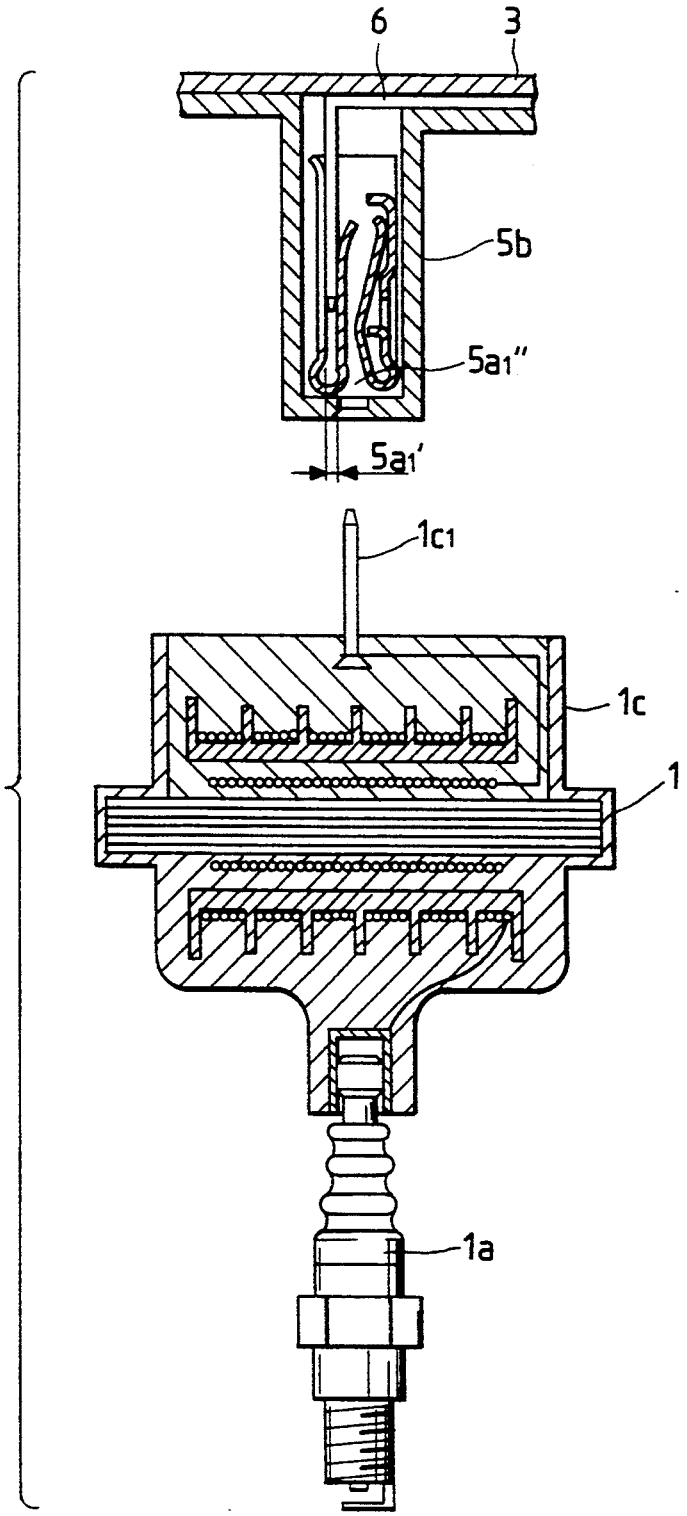
FIG. 3 is a sectional view showing engagement of a connector housing on the cylinder head cover with an ignition coil.

In this operation, as shown in FIG. 3, the cylinder head cover 3 is pushed downwardly with the connector housings 5*b* on the cylinder head cover 3 in alignment with the respective ignition coils 1. As a result, the contact terminals $1c_1$ of the ignition coils 1 are inserted into the contact gaps $5a_1''$ of the female metal terminals 5*a* held in the connector housings 5*b*, so that the female metal terminals 5*a* are electrically connected to the ignition coils 1, respectively.

In the final step, the screws 3*a* are fully tightened to positively secure the cylinder head cover 3 to the cylinder head 2*a*, whereby the contact terminals $1c_1$ are positively electrically connected to the female metal terminals 5*a*. Thereafter, a predetermined connector K is connected to the current receiving connector 4*a* of the igniter 4. Thus, the assembling work has been accomplished; that is, the ignition coils have been electrically connected as shown in FIG. 4.

Thus, in the case of the first embodiment of the invention, as the cylinder head cover 3 is mounted on the cylinder head, the connectors are automatically connected to the ignition coils in one action, which eliminates the troublesome work of connecting the connectors to the ignition coils one at a time.

FIG. 7 is an exploded perspective view for a description of a second embodiment of the invention.

As shown in FIG. 7, parts mounted on the upper portion of the engine, namely, ignition coils 1' with ignition plugs (not shown) below are mounted above cylinders formed in a cylinder head 2*a*' forming the upper portion of an engine body 1' with screws (not shown) inserted into through-holes (not shown). Each ignition plug 1a' has a spark section (not shown) which is exposed in the respective cylinder. Each ignition coil 1' has a current receiving connector $\mathbf{1}_c$ on top, which has contact terminals $\mathbf{1}c_1'$ which are held upright. Injectors 9, which are also mounted on the upper portion of the engine, are arranged on one side of the engine on the other side of which the ignition coils 1 of the cylinder head 2a' are arranged as was described before; more specifically, they are mounted on the intake manifolds (not shown) of the cylinders. Each injector 9 has a current receiving connector 8 which has contact terminals 8a extended upwardly.

A combined connector housing 5b' is formed on the inner surface of a cylinder head cover 3'. The combined connector housing 5b' has insertion holes 5c' which are formed in alignment with the ignition coils 1' to receive the contact terminals $\mathbf{1}c_1'$ of the ignition coils 1'. Female metal terminals (not shown) fitted in the combined connector housing 5b' are connected to the current receiving connector (not shown) of an igniter 4' through conductors 6' which are arranged in a predetermined pattern.

Another combined connector housing 10 is formed on the cylinder head cover 3' along the other edge. The combined connector housing 10 has insertion holes 10a which are formed in alignment with the contact terminals 8a of the current receiving connectors 8 of the injectors 9 to receive the contact terminals 8a. Female metal terminals (not shown) fitted in the combined connector housing 10 are connected to the current receiving connector (not shown) of the igniter 4 through conductors 6' which are arranged in a predetermined pattern.

The cylinder head cover 3' is made of polybutylene terephthalate or the like. The igniter 4' having the current receiving connector 4a' outside is mounted on the inner surface of one end portion of the cylinder head cover 3'. The current receiving connector 4a' incorporates connecting metal terminals (not shown) which are provided for the igniter 4' itself, and connecting metal terminals (not shown) which are to be connected to the conductors 6' which have been connected to the contact terminals 8a of the connectors 8 of the injectors 9.

FIG. 8 is a wiring diagram for the cylinder head cover 3' in the second embodiment of the invention. Some of the conductors 6 extended from the current receiving connector 4a' of the igniter 4' mounted on the cylinder head cover 3' (indicated by the one-dot chain line) are electrically connected through the current receiving connectors 1c' fitted in the combined connector housing 5b' (indicated by the two-dot chain lines) to the ignition coils 1' mounted above the cylinders in the engine body 2, and to the ignition plugs 1a', respectively. The remaining conductors 6 extended from the current receiving connector 4a' are electrically connected to the current receiving connectors 8 fitted in the combined connector housing 10, and to the injectors 9, respectively.

As is apparent from the above description, the second embodiment of the invention is equal in arrangement and in manufacturing method to the first embodiment except that the combined connector housing 5b' is provided for the ignition coils, and the combined connector housing 10 for the current receiving connectors 8 of the injectors 9 is provided on the inner surface of the cylinder head cover 3'.

Thus, the second embodiment of the invention is free from the troublesome work of connecting the connectors to the connectors to the ignition coils 1' and the injectors 9 one at a time. That is, with the second embodiment, the connectors are automatically connected to the ignition coils and the injectors in one action when the cylinder head cover 3' is mounted on the cylinder head of the engine.

As was described above, in the method of electrically wiring parts mounted on the upper portion of a gasoline engine, the contact terminals of the current receiving connectors for the parts are provided on the upper portion of the engine in such a manner that they are held upright, and the current supplying connectors are integrally mounted on the cylinder head cover in alignment with the contact terminals. Hence, electrically wiring those parts are accomplished automatically in one action when the cylinder head cover is mounted on the cylinder head. Thus, the method of the invention is considerably effective in electrically wiring parts mounted on the gasoline engine.

What is claimed is:

1. An electrical wiring device for distributing a signal through a wire harness to at least one of an ignition coil and an injector mounted on an upper portion of an engine via a current receiving device on each of said at least one ignition coil and injector, said wiring device comprising:

a current supplying connector associated with each of said at least one ignition coil and injector for supplying said signal, via said current receiving device, to said at least one ignition coil and injector, said current supplying connector being integrally formed on the inner surface of a cylinder head cover in such a manner that said current supplying connector electrically interfaces with said current receiving device when said cover is installed; and a current supplying circuit, electrically connected to said current supplying connector, for supplying said signal to said current supplying connector.

2. An electrical wiring device as claimed in claim 1, wherein said current supplying device has a current supplying unit for each of said one injector and connector.

3. An electrically wiring device as claimed in claim 1, wherein said current supplying device, said current supplying circuit and said current receiving connector are integrally provided on said cylinder head cover.

4. An electrical wiring device for an internal combustion engine, for distribution of electrical currents through a wire harness to at least one of an ignition coil and an electrical injector both of which are mounted on an upper portion of said internal combustion engine and wherein each of said ignition coil and electrical injector are equipped with current receiving devices and;

said electrical wiring device is integrally formed on an inner surface of a cylinder head cover in such a manner that when said cylinder head cover is installed, it provides an electrical interface between at least one of said ignition coil and electrical injector current receiving devices, and at least one of several current supplying devices integral to said electrical wiring device and;

a current supplying circuit for supplying said electrical currents to said electrical wiring device is provided with a first connector interfacing with and supplying current to a corresponding second connector on said electrical wiring device and;

further wherein said current supplying devices integral to said cylinder head cover electrical wiring device are so designed as to interface and be compatible with said current receiving devices with which said ignition coils and electrical injectors are equipped.

* * * * *